US006559588B1

(12) United States Patent
Choi

(10) Patent No.: US 6,559,588 B1
(45) Date of Patent: May 6, 2003

(54) DEFLECTION YOKE

(75) Inventor: Kwang Yun Choi, Uiwang-Shi (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 268 days.

(21) Appl. No.: 09/596,089

(22) Filed: Jun. 16, 2000

(51) Int. Cl.[7] ..... H01J 29/70; H01F 7/00; H01F 3/12; H01F 1/00

(52) U.S. Cl. ..... 313/440; 335/210; 335/211; 335/212

(58) Field of Search ..... 313/440; 335/210–212

(56) References Cited

U.S. PATENT DOCUMENTS

| | | | | | |
|---|---|---|---|---|---|
| 4,267,541 | A | * | 5/1981 | Narikiyo | 335/210 |
| 5,227,692 | A | * | 7/1993 | Lee | 313/412 |
| 5,786,661 | A | * | 7/1998 | Kim | 313/440 |
| 5,811,922 | A | * | 9/1998 | Yi | 313/440 |
| 5,818,158 | A | * | 10/1998 | Kim | 313/431 |
| 5,818,317 | A | * | 10/1998 | Takagishi | 335/211 |
| 6,211,610 | B1 | * | 4/2001 | Nakajima | 313/440 |

FOREIGN PATENT DOCUMENTS

| | | | | |
|---|---|---|---|---|
| JP | 09045261 | A | * 2/1997 | H01J/29/76 |

* cited by examiner

*Primary Examiner*—Nimeshkumar D. Patel
*Assistant Examiner*—Anthony Perry
(74) *Attorney, Agent, or Firm*—Ladas & Parry

(57) ABSTRACT

A deflection yoke for CRTs, designed to easily correct a misconvergence in a vertical direction of a frame without being rotated during a frame correction step, is disclosed. The deflection yoke has a coil separator composed of a screen part, a rear cover part and a neck part. A plurality of horizontal and vertical deflection coils are set on the internal and external surfaces of the coil separator and generate horizontal and vertical deflection magnetic fields. A correction means is provided on the rear cover part of the coil separator and corrects the vertical magnetic field in addition to frame dispersion. A position adjusting means is provided at a position between the rear cover part and the correction means and holds the correction means on the rear cover part while allowing the position of the correction means relative to the rear cover part to be finely and precisely adjustable. This deflection yoke precisely and stably corrects both the frame dispersion and the vertical magnetic field. In the correction means, two correction pieces are connected together into a single structure by a guider. This guider also almost completely prevents the correction pieces from being undesirably displaced on or removed from the rear cover part, thus improving the operational reliability of the deflection yoke.

7 Claims, 7 Drawing Sheets

DEFLECTION YOKE

BACKGROUND OF THE INVENTION

1. Field of the Invention

The present invention relates to deflection yokes and, more particularly, to a mounting device provided on the coil separator of such a deflection yoke for allowing a frame correction means to be easily and precisely mounted to the coil separator of the deflection yoke.

2. Description of the Prior Art

As well known to those skilled in the art, deflection yokes for CRTs (cathode ray tubes) of TV receivers or computer monitors have been typically classified into a plurality of types, for example, saddle-toroidal type yokes and saddle-saddle type yokes.

As shown in FIG. 1, a deflection yoke 10 is typically mounted to the neck part 2 of a CRT 1. Such deflection yokes 10 are generally classified into two types, or saddle-saddle type deflection yokes of FIGS. 2 and 3 and saddle-toroidal type deflection yokes of FIGS. 4 and 5, in accordance with a coil structure.

Such a deflection yoke 10 is used for appropriately deflecting the B (blue), R (red) and G (green) light beams, emitted from a BRG electron gun 3 set within the neck part 2 of the CRT 1, upward, downward, leftward and/or rightward, thus allowing the light beams to precisely reach the desired positions on the fluorescent screen of the CRT 1 and to form a desired picture on the screen.

FIGS. 2 and 3 show the construction of a conventional saddle-saddle type deflection yoke. In such a conventional saddle-saddle type deflection yoke, a plurality of saddle-type horizontal deflection coils 12 are installed on the internal surface of the screen part of a generally conical coil separator 11 at upper and lower portions as shown in the drawings. In addition, a plurality of saddle-type vertical deflection coils 13 are installed the external surface of the screen part of the coil separator 11 at left and right portions.

A ferrite core 14, having a generally cylindrical shape, is provided on the external surface of the screen part of the coil separator 11 for correcting the magnetic field formed by the vertical deflection coils 13.

On the other hand, a plurality of coma free coils 15 are mounted to the external surface of the coil separator 11 at a position around the neck part and are used for correcting the coma formed by the vertical deflection coils 13.

FIGS. 4 and 5 show the construction of a conventional saddle-toroidal type deflection yoke. In such a conventional saddle-toroidal type deflection yoke, a plurality of horizontal deflection coils 12 are installed on the internal surface of the screen part of a generally conical coil separator 11 at upper and lower portions as shown in the drawings. In addition, a ferrite core 14, having a generally cylindrical shape, is provided on the external surface of the screen part of the coil separator 11. In addition, a plurality of toroidal-type vertical deflection coils 16 are installed on the external surface of the above ferrite core 14 at upper and lower portions.

On the other hand, a plurality of coma free coils 15 are mounted to the external surface of the core separator 11 at a position around the neck part and are used for correcting the coma formed by the vertical deflection coils 16.

However, such conventional deflection yokes have the following problems. In the case of the saddle-saddle type deflection yoke of FIGS. 2 and 3, it is necessary to mount the ferrite core 14, having the vertical deflection coils 13, on the external surface of the coil separator 11 having the horizontal deflection coils 12. However, a frame misconvergence may be easily induced in both the dimension dispersion of the ferrite core 14 and the winding dispersion of the vertical deflection coils 13 during a process of locking the ferrite core 14 to the external surface of the coil separator 11.

That is, both a misconvergence in a vertical direction and a misconvergence in a horizontal direction are formed in such a conventional deflection yoke as shown in FIGS. 6 and 7.

Such misconvergences are corrected as follows in the prior art. That is, the misconvergence in the horizontal direction may be corrected by a correction piece 20. Such a correction piece 20 is set on the rear plate 11*a* of the coil separator 11 as shown in FIG. 8 and corrects the magnetic field in the horizontal direction. On the other hand, the misconvergence in the vertical direction may be corrected by correcting the magnetic field in the vertical direction. Such a correction of the vertical magnetic field may be accomplished by controlling the volume of a circuit board (not shown) provided on a sidewall of the coil separator 11 or by rotating the deflection yoke 10 around the CRT 1.

In the prior art, the desired correction of the vertical magnetic field may be somewhat effectively accomplished by controlling the volume of the circuit board or by rotating the deflection yoke 10. However, such a correction of the vertical magnetic field performed by controlling the volume of the circuit board undesirably gives bad effects on the environmental magnetic field, such as the magnetic field in the vertical direction. This forces an additional correction process to be necessarily performed to correct the environmental magnetic field. On the other hand, the correction of the vertical magnetic field performed by rotating the deflection yoke 10 around the CRT 1 undesirably gives bad effects on a final processing step, or on an ITC step, thus deteriorating work efficiency during such an ITC step.

SUMMARY OF THE INVENTION

Accordingly, the present invention has been made keeping in mind the above problems occurring in the prior art, and an object of the present invention is to provide a deflection yoke, which is designed to easily correct a misconvergence in a vertical direction of a frame, and which is not rotated during a frame correction step, thus being free from requiring an additional correction step or affecting an ITC step.

In order to accomplish the above object, the present invention provides a deflection yoke, comprising: a coil separator composed of a screen part positioned around a screen of a CRT, a rear cover part extending from the screen part to the back and covering a rear portion of the CRT, and a neck part extending from the rear cover part to the back and covering an electron gun of the CRT; a plurality of horizontal and vertical deflection coils set on the internal and external surfaces of the coil separator and used for generating horizontal and vertical deflection magnetic fields; a correction means provided on the rear cover part of the coil separator and used for correcting the vertical magnetic field in addition to a frame dispersion; and a position adjusting means provided at a position between the rear cover part and the correction means and used for holding the correction means on the rear cover part while allowing the position of the correction means relative to the rear cover part to be finely and precisely adjustable.

In the above deflection yoke, the correction means comprises: two guide rails formed on the rear cover part in a way such that the two guide rails are oppositely positioned around the neck part of the coil separator, with a guide groove being axially formed along an inside surface of each of the guide rails; two correction pieces movably set in the guide grooves of the guide rails and used for correcting the vertical magnetic field in addition to the frame dispersion; and a guider connecting opposite outside ends of the correction pieces to each other into a single body.

The correction pieces are preferably formed of a metal, and the guider is preferably formed of a plastic material.

The correction pieces are integrated with the guider into a single structure by inserting the correction pieces into the guider during a molding process of forming the guider.

In the above deflection yoke, the position adjusting means comprises: a plurality of fixed teeth formed on the external surface of the rear cover part at positions around the guide rails; and a plurality of movable teeth formed on the lower surface of the correction means and used for movably engaging with the fixed teeth of the rear cover part.

The movable teeth are formed on the lower surface of each end portion of the guider of the correction means.

The rear cover part is also provided with an elastic piece at a position corresponding to the correction means, the elastic piece having an upward elasticity so as to prevent an undesirable displacement of the correction means relative to the rear cover part.

The fixed teeth are formed on the above elastic piece.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
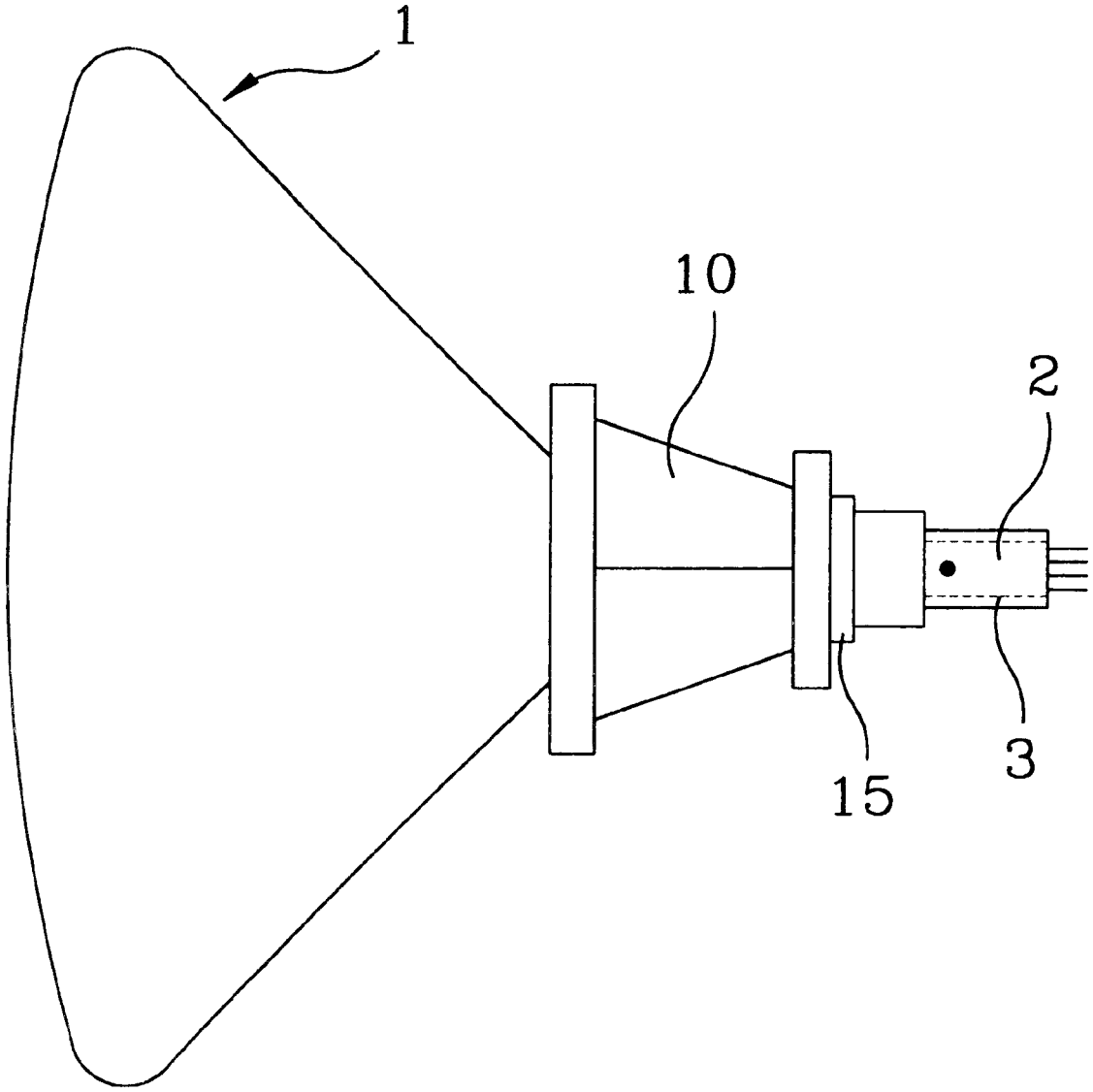
F I G. 1 PRIOR ART
FIG. 1 is a sectional view of a CRT provided with a conventional deflection yoke.
Figure 2:
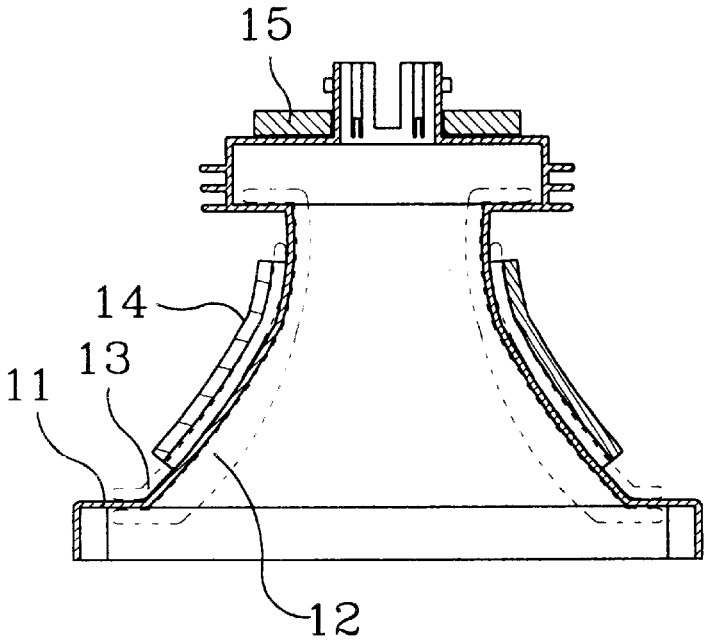
F I G. 2 PRIOR ART
FIGS. 2 and 3 are sectional views of a conventional saddle-saddle type deflection yoke.
Figure 3:
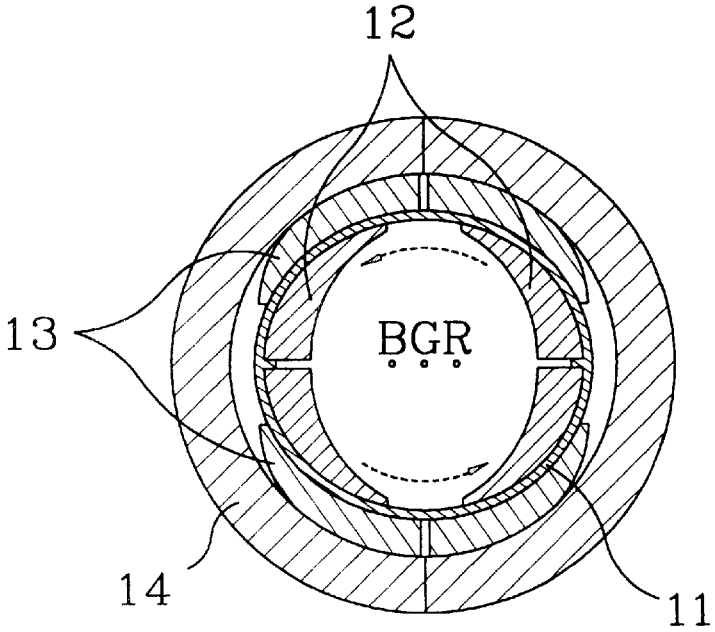
F I G. 3 PRIOR ART
Figure 4:
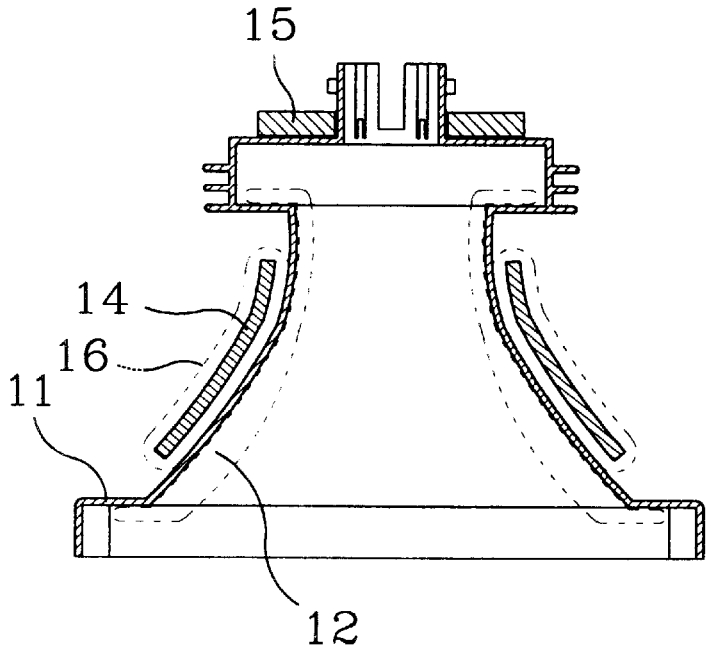
FIG. 4 PRIOR ART
FIGS. 4 and 5 are sectional views of a conventional saddle-toroidal type deflection yoke.
Figure 5:
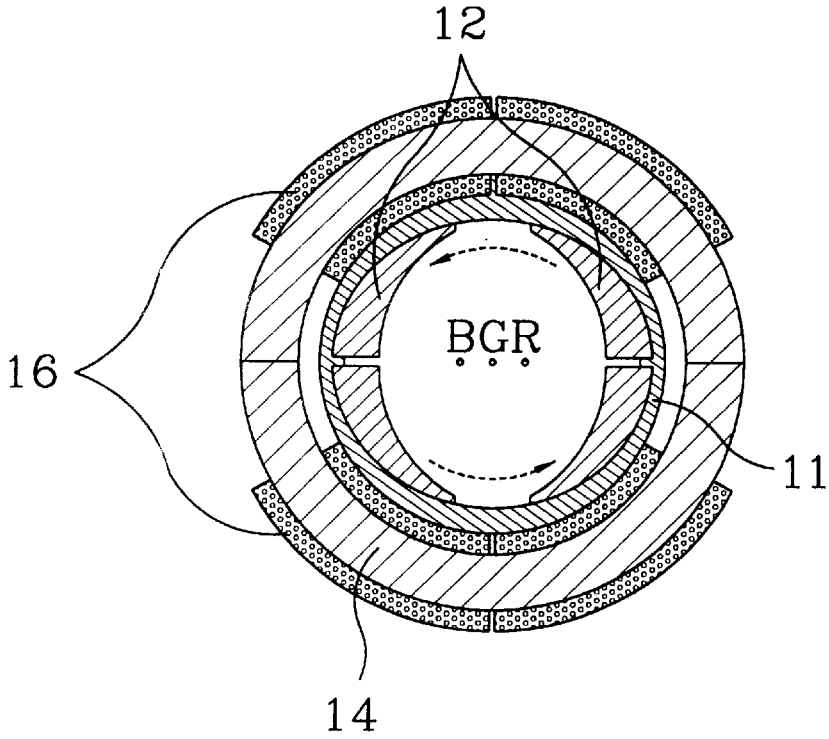
FIG. 5 PRIOR ART
Figure 6:
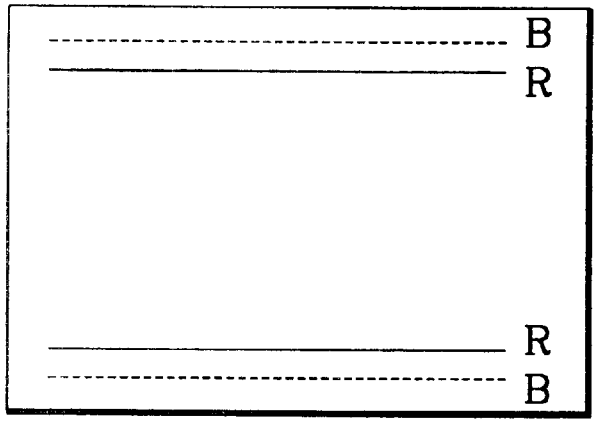
FIG. 6 PRIOR ART
FIGS. 6 and 7 are views, showing misconvergences in vertical and horizontal directions on a frame.
Figure 7:
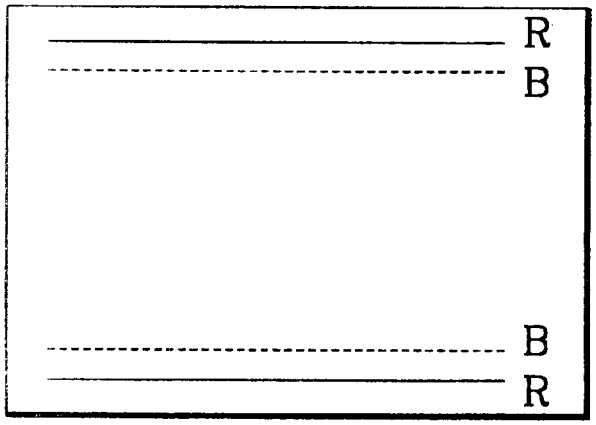
FIG. 7 PRIOR ART
Figure 8:
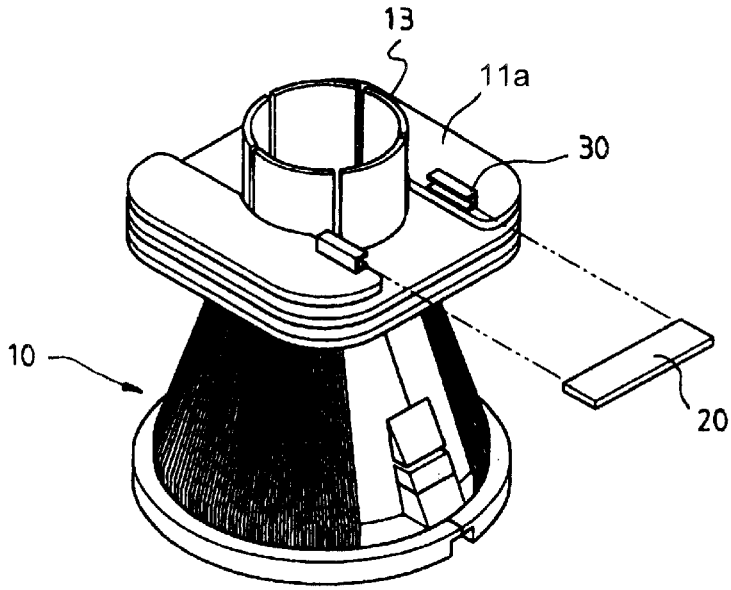
F I G. 8 PRIOR ART
FIG. 8 is a perspective view of a deflection yoke provided with a conventional misconvergence correction means.
Figure 9:
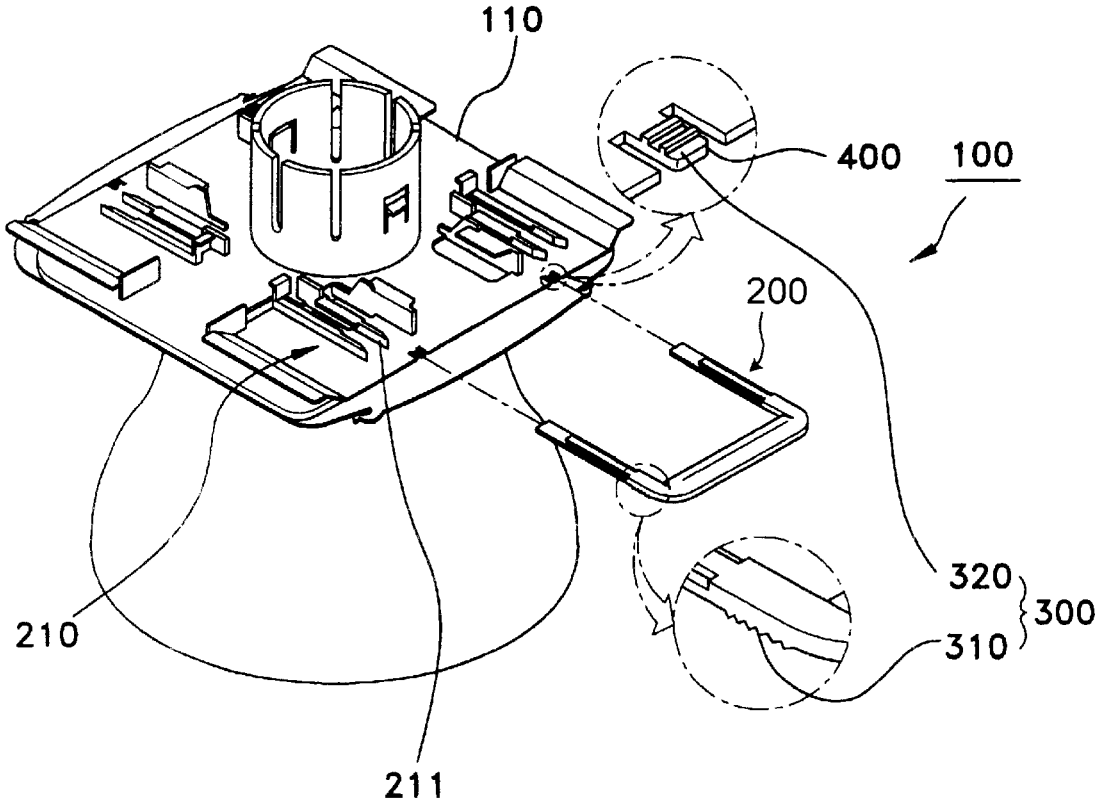
FIG. 9 is a perspective view of a deflection yoke in accordance with the preferred embodiment of the present invention.
Figure 10:
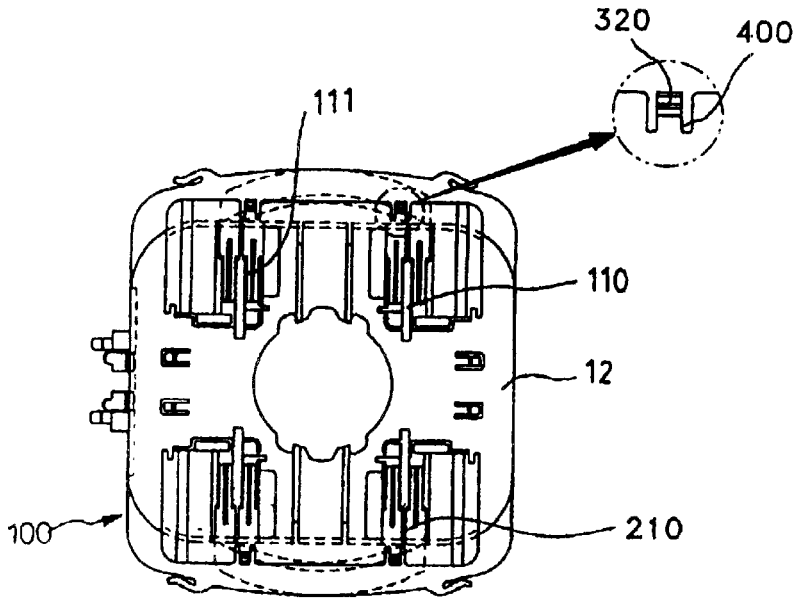
FIG. 10 is a plan view of the deflection yoke of FIG. 9.

FIGS. 9 to 13 show a deflection yoke in accordance with the preferred embodiment of the present invention. As shown in the drawings, the deflection yoke 100 of this invention comprises a coil separator 110, which is composed of two portions, or left and right portions having the same size and shape and integrated into a single body.

Figure 11:
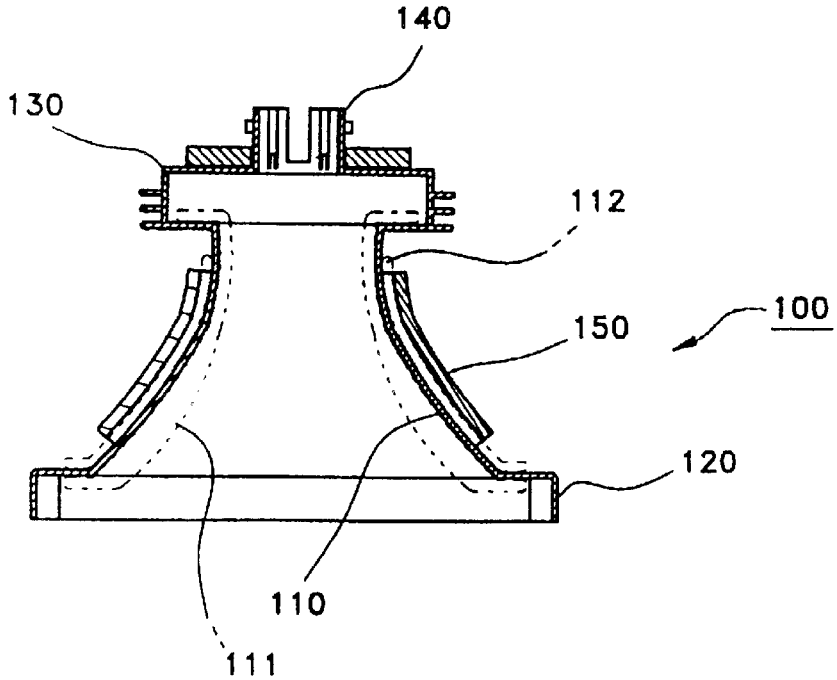
FIG. 11 is a sectional view of the deflection yoke of this invention.
Figure 12:
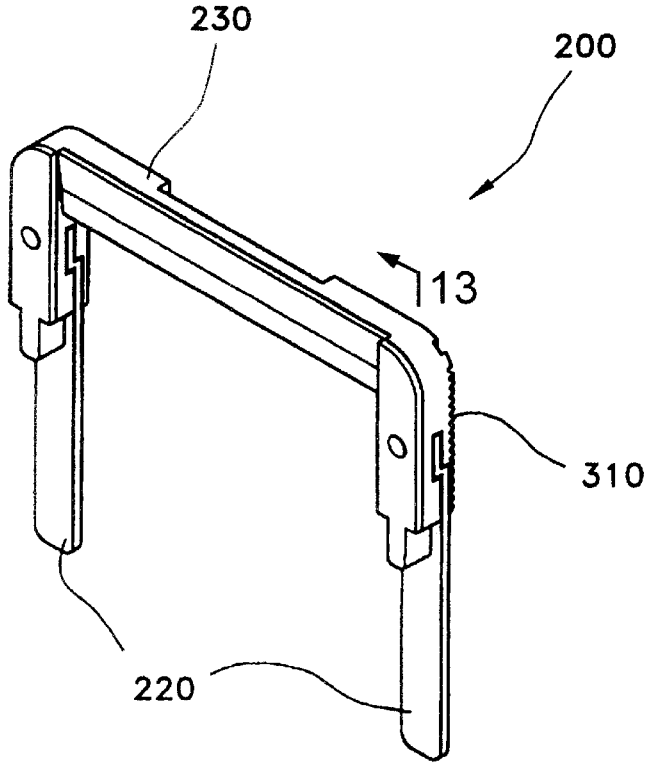
FIG. 12 is a perspective view of a frame correction means included in the deflection yoke of this invention.
Figure 13:
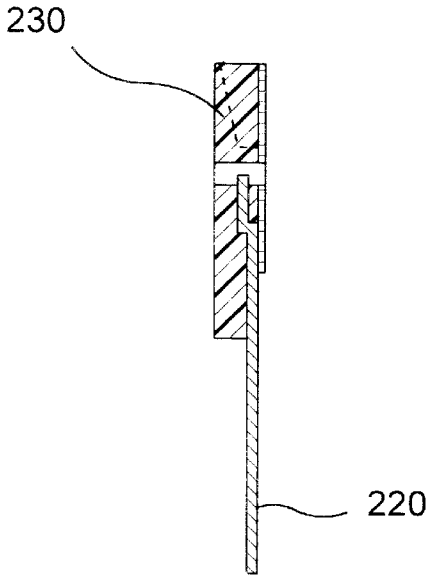
FIG. 13 is a sectional view of the deflection yoke of this invention taken along the line A—A of FIG. 12.

As best seen in FIG. 11, the coil separator 110 comprises three parts, or a screen part 120, a rear cover part 130 and a neck part 140. The screen part 120 is positioned around the screen of a CRT 1. The rear cover part 130 extends from the screen part 120 to the back so as to cover the rear portion of the CRT 1. On the other hand, the neck part 140 extends from the rear cover part 120 to the back and covers the electron gun of the CRT 1.

A plurality of horizontal deflection coils 111 are set on the internal surface of the coil separator 110 and generate a horizontal deflection magnetic field capable of deflecting the light beams, emitted from the electron gun, in a horizontal direction. On the other hand, a plurality of vertical deflection coils 112 are set on the external surface of the coil separator 110 and generate a vertical deflection magnetic field capable of deflecting the light beams of the electron gun in a vertical direction.

A ferrite core 150 is mounted on the external surface of the coil separator 110, for example, by a clamp, and enhances the magnetic fields generated by the horizontal and vertical deflection coils 111 and 112.

A correction means 200 is provided on the rear cover part 130 of the coil separator 110 and is used for correcting the vertical magnetic field in addition to frame dispersion. A position adjusting means 300 is provided at a position between the rear cover part 130 and the correction means 200. The above position adjusting means 300 is used for allowing the position of the correction means 200 relative to the rear cover part 130 to be finely and precisely adjusted.

The detailed construction of the above correction means 200 is shown in FIGS. 9 to 12. As shown in the drawings, the correction means 200 comprises two guide rails 210, two correction pieces 220 and a guider 230.

The guide rails 210 are formed on the rear cover part 130 in a way such that the rails 210 are oppositely positioned around the neck part 140, with a guide groove 211 being axially formed along the inside surface of each guide rail 210.

The correction pieces 220, movably set in the guide grooves of the guide rails 210, are members practically correcting both the frame dispersion and the vertical magnetic field.

On the other hand, the guider 230 is used for stably guiding the correction pieces 220 when the correction pieces 220 are inserted into the guide rails 210. The collateral function of the above guider 230 is to connect the opposite outside ends of the correction pieces 220 to each other into a single body. That is, the correction pieces 220 are assembled into a single structure by the guider 230 positioned between them.

The above correction pieces 220 are preferably made of a metal through a pressing process, while the guider 230 is preferably made of a plastic material through an injection molding process.

In the present invention, it is preferable to integrate the correction pieces 220 with the guider 230 into a single structure by performing the injection molding process of forming the guider 230 with the correction pieces 220 set in desired positions around the guider 230. This finally improves work efficiency while manufacturing the correction means 200.

The position adjusting means 300 is used for finely and precisely adjusting the position of the correction means 200 relative to the rear cover part 130 while finely correcting the magnetic field. The above position adjusting means 300 comprises a plurality of fixed teeth 320 formed on the rear cover part 130 at a position around the guide rails 210. The position adjusting means 300 also comprises a plurality of movable teeth 310 formed on the lower surface of the correction means 200. The movable teeth 310 movably engage with the fixed teeth 320, thus holding the position of the correction means 200 relative to the rear cover part 130 while allowing the position of the correction means 200 to be finely and precisely adjustable.

That is, the movable teeth 310 of the position adjusting means 300 are formed on the lower surface of each end portion of the guider 230 of the correction means 200, while the fixed teeth 320 are formed on the top surface of the rear cover part 130 at a position corresponding to the movable teeth 310.

In the deflection yoke 100 of this invention, it is necessary to allow an easy engagement of the guider 230 of the correction means 200 with the rear cover part 130 without allowing an undesirable movement of the guider 230 relative to the rear cover part 130. In order to accomplish the above object, the edge of the rear cover part 130 is slit to a length at two positions, thus forming two elastic pieces 400 having a predetermined width and a desired upward elasticity. The fixed teeth 320 are formed on the top surface of each elastic piece 400.

The deflection yoke 100 of this invention is assembled as follows. The correction pieces 220 of the correction means 200, which are used for practically correcting the frame dispersion and enhancing the vertical magnetic field, are inserted into the guide rails 210 formed on the rear cover part 130.

In such a case, it is possible to insert the correction pieces 220 of the correction means 200 into the guide rails 210 of the rear cover part 130 while finely and precisely adjusting the position of the correction means 200 relative to the rear cover part 130 by controlling the engaging position between the movable teeth 310 and the fixed teeth 320.

That is, a desired precise correction of the vertical magnetic field is accomplished by finely and precisely adjusting the position of the correction pieces 220 relative to the rear cover part 130.

On the other hand, when the correction pieces 220 of the correction means 200 are completely set in the guide rails 210 of the rear cover part 130, the guider 230 of the correction means 200 is locked to the guide rails 210 while being upwardly biased by the two elastic pieces 400. Therefore, the correction pieces 220 are almost completely free from being undesirably movable relative to the guide rails 210 of the rear cover part 130.

This finally prevents the correction pieces 220 from an undesirable displacement on the guide rails 210 or an unexpected removal from the rails 210 even though a person unconsciously touches the pieces 220.

As described above, the present invention provides a deflection yoke, of which the correction pieces of a correction means are designed to be finely and precisely movable relative to the guide rails of a rear cover part. Therefore, it is possible for the deflection yoke of this invention to precisely and stably correct both frame dispersion and a vertical magnetic field.

In addition, the two correction pieces are connected together into a single structure by a guider. This guider also almost completely prevents the correction pieces from being undesirably displaced on or removed from the rear cover part, thus improving the operational reliability of the deflection yoke. The present invention also improves work efficiency while assembling the correction pieces with the rear cover part.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A deflection yoke, comprising:

a coil separator comprising:

a screen part positioned around a screen of a cathode ray tube (CRT);

a rear cover part extending from said screen part to the back and covering a rear portion of said CRT; and a neck part extending from said rear cover part to the back and covering an electron gun of said CRT;

a plurality of horizontal and vertical deflection coils set on internal and external surfaces of said coil separator and used for generating horizontal and vertical deflection magnetic fields;

correction means provided on said rear cover part of the coil separator and used for correcting the vertical magnetic field in addition to a frame dispersion; said correction means comprising a pair of guide rails having guide grooves formed on inside surfaces of said guide rails, two correction pieces made of metal, and engaged in the guide grooves in the inside surfaces of the guide rails for correcting the vertical magnetic field, and a guider connecting outside ends of the correction pieces to each other, said guider being made of a plastic material; and position adjusting means provided at a position between said rear cover part and said correction means and used for holding the correction means on the rear cover part while allowing the position of the correction means relative to the rear cover part to be finely and precisely adjustable.

2. The deflection yoke according to claim 1, wherein said correction pieces are integrated with said guider into a single structure by inserting the correction pieces into the guider during a molding process of forming said guider.

3. The deflection yoke according to claim 1, wherein said position adjusting means comprises:

a plurality of fixed teeth formed on an external surface of said rear cover part at positions around the guide rails; and a plurality of second teeth formed on a lower surface of said correction means and used for movably engaging with the fixed teeth of the rear cover part.

4. The deflection yoke according to claim 3, wherein said second teeth are formed on the lower surface of each end portion of said guider of the correction means.

5. The deflection yoke according to claim 3, wherein said rear cover part is provided with an elastic piece at a position corresponding to said correction means, said elastic piece having an upward elasticity so as to prevent an undesirable displacement of the correction means relative to the rear cover part.

6. The deflection yoke according to claim 5, wherein said elastic piece is provided with the fixed teeth thereon.

7. The deflection yoke according to claim 1, wherein said pair of guide rails are positioned on opposite sides of said neck part said guide grooves extending axially in said inside surfaces os said guide rails.

* * * * *

UNITED STATES PATENT AND TRADEMARK OFFICE

CERTIFICATE OF CORRECTION

PATENT NO. : 6,559,588 B1
DATED : May 6, 2003
INVENTOR(S) : Kwang Yun Choi

It is certified that error appears in the above-identified patent and that said Letters Patent is hereby corrected as shown below:

Title page,
Item [*], Notice: "268" should read -- 319 --.

Signed and Sealed this

Second Day of September, 2003

JAMES E. ROGAN
*Director of the United States Patent and Trademark Office*